United States Patent [19]

Wood

[11] Patent Number: 4,568,499

[45] Date of Patent: Feb. 4, 1986

[54] CARBURETOR WITH SELF SEATING NEEDLE VALVE

[75] Inventor: LeRoy T. Wood, Racine, Wis.

[73] Assignee: Outboard Marine Corporation, Waukegan, Ill.

[21] Appl. No.: 629,217

[22] Filed: Jul. 9, 1984

[51] Int. Cl.[4] ..... F02M 3/08

[52] U.S. Cl. ..... 261/41 D; 251/268; 251/DIG. 4; 251/227; 251/291; 261/DIG. 38; 261/71

[58] Field of Search ..... 251/268, DIG. 4, 267, 251/291, 227; 261/DIG. 38, 41 D, 71

[56] References Cited

U.S. PATENT DOCUMENTS

| | | | |
|---|---|---|---|
| 544,752 | 8/1895 | Strater | 251/268 |
| 981,630 | 1/1911 | Franks | 251/DIG. 4 |
| 1,160,176 | 11/1915 | Jeannotte | 251/268 |
| 1,274,297 | 7/1918 | Lorenzen | 251/268 |
| 1,398,025 | 11/1921 | James | 251/268 |
| 1,432,527 | 10/1922 | Burdett | 251/268 |
| 1,561,974 | 11/1925 | Giudice | 251/291 |
| 1,716,195 | 6/1929 | Stockstrom | 251/DIG. 4 |
| 1,718,763 | 6/1929 | Sladky et al. | 251/DIG. 4 |
| 1,746,055 | 2/1930 | Roberts et al. | 251/DIG. 4 |
| 2,739,612 | 3/1956 | Hansen | 251/291 |
| 3,484,084 | 12/1969 | Simpson et al. | 261/DIG. 38 |
| 3,976,279 | 8/1976 | Walker | 251/267 |
| 4,099,703 | 7/1978 | Lush | 251/122 |
| 4,283,353 | 8/1981 | Miller | 261/DIG. 38 |
| 4,417,601 | 11/1983 | Bennett | 251/122 |
| 4,462,346 | 7/1984 | Haman et al. | 123/73 R |
| 4,499,887 | 2/1985 | Billingsley et al. | 123/1 A |

FOREIGN PATENT DOCUMENTS

| | | | |
|---|---|---|---|
| 541322 | 5/1922 | France | 251/291 |

*Primary Examiner*—Tim Miles

*Attorney, Agent, or Firm*—Michael, Best & Friedrich

[57] ABSTRACT

A carburetor comprising a fuel/air induction passage, a secondary orifice communicating with the induction passage, and a fuel supply system operable to supply fuel from a source of fuel to the secondary orifice, the fuel supply system including a wall defining an elongated enclosed chamber having a longitudinal axis and a first end, the wall including an inlet communicating between the source of fuel and the chamber, and, at the second end, an outlet communicating between the chamber and the secondary orifice, the outlet including a valve seat, a valve member within the chamber and including a needle portion adapted to engage the valve seat, the valve member being movable within the chamber along the longitudinal axis of the chamber relative to a closed position wherein the needle portion sealingly engages the valve seat, a spring biasing the valve member toward the closed position, and an adjustment rod selectively engageable with the valve member for selectively and releasably moving the valve member away from the closed position.

20 Claims, 4 Drawing Figures

CARBURETOR WITH SELF SEATING NEEDLE VALVE

BACKGROUND OF THE INVENTION

The invention relates to carburetors and, more particularly, to needle valves used in carburetors.

In many known carburetor needle valves, the needle is attached to the end of a rod that is threadedly engaged with the body of the carburetor. The needle is seated by turning the rod, thereby causing the rod to move inwardly into the carburetor. With such needle valves, it is difficult to "feel" when the needle is properly seated. This difficulty often results in overseating, which damages the needle as well as the seat, when the rod is turned too far. This damage results in costs for replacement parts and downtime for repairs, and can be especially great in plastic carburetors.

Another disadvantage of these needle valves is that the carburetor body must be threaded in order to receive the threaded rod to which the needle is attached.

Attention is directed to the following U.S. Patents:

Bennett U.S. Pat. No. 4,417,601, issued Nov. 29, 1983;

Lush U.S. Pat. No. 4,099,703, issued July 11, 1978;

Burdett U.S. Pat. No. 1,432,527, issued Oct. 17, 1922;

James U.S. Pat. No. 1,398,025, issued Nov. 22, 1921; and

Strater U.S. Pat. No. 544,752, issued Aug. 20, 1895.

Attention is also directed to the following copending U.S. Pat. Applications:

Billingsley et al. Appl. Ser. No. 461,866, filed Jan. 28, 1983 and entitled "Dual Fuel Supply System"; now U.S. Pat. No. 4,499,887 issued Feb. 10, 1985, and Haman et al. Appl. Ser. No. 406,446, filed Aug. 9, 1982 and entitled "Fuel Supply System for Internal Combustion Engine", now U.S. Pat. No. 4,462,346 issued July 31, 1984.

SUMMARY OF THE INVENTION

The invention provides a carburetor comprising a fuel/air induction passage, a secondary orifice communicating with the induction passage, and fuel supply means operable to supply fuel from a source of fuel to the secondary orifice. The fuel supply means includes wall means defining an elongated enclosed chamber having a longitudinal axis and a first end, the wall means including an inlet communicating between the source of fuel and the chamber, and, at the second end, an outlet communicating between the chamber and the secondary orifice, the outlet including a valve seat. The fuel supply means also includes a valve member within the chamber and including a needle portion adapted to engage the valve seat, the valve member being movable within the chamber along the longitudinal axis of the chamber relative to a closed position wherein the needle portion sealingly engages the valve seat, means biasing the valve member toward the closed position, and means selectively engageable with the valve member for selectively and releasably moving the valve member away from the closed position.

The invention also provides a valve apparatus comprising wall means defining an elongated enclosed chamber having a longitudinal axis and a first end, the wall means including an inlet and, at the second end, an outlet including a valve seat, a valve member within the chamber and including a needle portion adapted to engage the valve seat, the valve member being movable within the chamber along the longitudinal axis of the chamber relative to a closed position wherein the needle portion sealingly engages the valve seat, means biasing the valve member toward said closed position, and means selectively engageable with the valve member for selectively and releasably moving the valve member away from the closed position.

In one embodiment, the means biasing said valve member toward the closed position includes a spring positioned in the chamber between the valve member and the first end of the chamber.

In one embodiment, the chamber has a second end opposite the first end, the valve member has opposite first and second ends, the first end of the valve member facing the first end of the chamber and the second end of the valve member facing the second end of the chamber and including the needle portion, and the means selectively engageable with the valve member includes an adjustment rod extending through the wall means at the first end of the chamber and having an end extending inwardly into the chamber, and selectively interengageable means on the first end of the valve member and on the end of the adjustment rod.

In one embodiment, the chamber has a noncircular cross-sectional area, the valve member includes a body portion having a noncircular cross-sectional area less than the area of the chamber such that the body portion cannot rotate within the chamber, and the selectively interengageable means on the valve member and on the rod includes, in the first end of the valve member, an internally threaded bore with a longitudinal axis parallel to the longitudinal axis of the chamber, and, on the end of the rod, an externally threaded portion adapted to threadably engage the internally threaded bore in the valve member, the adjustment rod having a longitudinal axis colinear with the longitudinal axis of the threaded bore and being rotatable about and movable along the longitudinal axis of the rod inwardly into and outwardly of the chamber.

In one embodiment, the carburetor or valve apparatus further comprises means biasing the adjustment rod outwardly of the chamber, means restricting the movement of the adjustment rod outwardly of the chamber such that, when the end of the adjustment rod is out of engagement with the threaded bore, the end of the rod is positioned closely adjacent to the valve member, and means restricting the movement of the adjustment rod inwardly into the chamber such that, after the rod is moved inwardly into the chamber and rotated so that the threaded end of the rod engages the internally threaded bore in the valve member, further rotation of the rod causes the valve member to move away from the closed position.

In one embodiment, the wall means includes an inner surface and an outer surface, the inner surface defining the chamber, and the means restricting the movement of the adjustment rod outwardly of the chamber includes an adjustment rod clip mounted on the outer surface of the wall means and having a portion spaced from the outer surface and including an aperture in which the adjustment rod is slidably received, and a member fixedly attached to the adjustment rod to prevent axial movement thereof and being positioned between the portion of the clip and the outer surface of the wall means so as to be engageable with the portion of the clip to prevent further movement of the adjustment rod outwardly of the chamber.

In one embodiment, the means biasing the adjusment rod outwardly of the chamber and the means restricting the movement of the adjustment rod inwardly into the chamber both include a spring surrounding the adjustment rod and being positioned between the member and the outer surface of the wall means, the spring biasing the adjustment rod outwardly of the chamber and, when fully compressed, preventing movement of the adjustment rod inwardly into the chamber.

In one embodiment, the wall means is made of plastic.

A principal feature of the invention is that the needle is seated by a spring, rather than by the turning of a valve by a human operator. This substantially avoids overseating and the resulting costs for replacement parts and downtime for repairs.

Another principal advantage of the invention is that the carburetor body need not be threaded in order to receive the adjustment rod. This makes manufacturing of the carburetor more economical.

Other features and advantages of the invention will become apparent to those skilled in the art upon review of the following detailed description, claims, and drawings.

Figure 1:
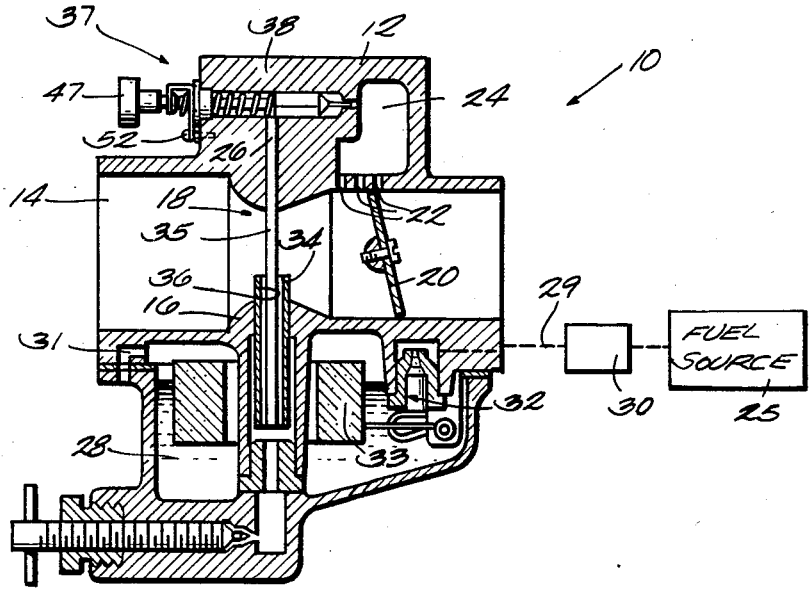
FIG. 1 is a cross-sectional side view of a carburetor embodying the invention.

Before explaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawing is a fuel supply system 10 for an internal combustion engine (not shown). The fuel supply system 10 includes a carburetor 12. It should be understood that the carburetor 12 described hereinafter is merely the preferred embodiment of the invention, and that the invention relates to any carburetor or needle valve apparatus within the scope of the claims.

In the preferred embodiment, the main body of the carburetor 12 is made of plastic. The carburetor 12 has a fuel/air induction passage 14 communicating with the engine fuel intake (not shown) and including a venturi 16 having a throat defining a low pressure zone 18. Mounted downstream of the venturi 16 is a throttle valve 20 which is movable between open and closed positions to control the flow of fuel and air through the fuel/air induction passage 14 and thus engine speed. Located in the wall of the fuel/air induction passage 14 adjacent the periphery of the throttle valve 20 is one or more secondary orifices 22, each of which communicates with a fuel cavity or well 24 in the carburetor 12.

The carburetor 12 also includes fuel supply means operable to supply fuel from a source of fuel 25 to the fuel well 24. The fuel supply means includes a fuel duct or passage 26 through which fuel is supplied from the source of fuel 25 to the fuel well 24. The flow of fuel from the fuel passage 26 to the fuel well 24 is provided and controlled by a needle valve apparatus 37 described hereinafter.

The fuel supply means also includes a fuel chamber or float bowl 28. Fuel, such as gasoline or kerosene, is supplied to the float bowl 28 from the source of fuel 25 via an inlet hose or conduit 29 and a fuel pump 30 or other suitable means. The carburetor 12 includes a vent 31 through which the float bowl 28 is vented to the atmosphere.

Flow of the fuel to the float bowl 28 is controlled by a valve 32 which is connected to a float 33 and opens and closes in response to movement of the float 33. Thus, the valve 32 and float 33 serve to maintain a predetermined level of the fuel in the float bowl 28. Fuel is supplied from the float bowl 28 to the low pressure zone 18 through a fuel nozzle 34 extending between the float bowl 28 and the low pressure zone 18.

Fuel is supplied from the float bowl 28 to the fuel passage 26 by a pick-up conduit or tube 35 which extends between the float bowl 28 and the fuel passage 26. While other arrangements can be used, in the specific construction illustrated, the pick-up tube 35 is located inside the fuel nozzle 34 and an annular flow passage 36 is defined therebetween.

As the engine cranks, during starting of normal operations, a flow of fuel is induced from the float bowl 28 through the pick-up tube 35, and through the fuel passage 26 and the needle valve apparatus 37 into the fuel well 24. From the fuel well 24, the fuel flows through the secondary orifices 22 and into the fuel/air induction passage 14. Also at the same time a flow of fuel is induced from the float bowl 28 through the annular passage 36 between the pick-up tube 35 and the fuel nozzle 34 and into the low pressure zone 18.

Figure 2:
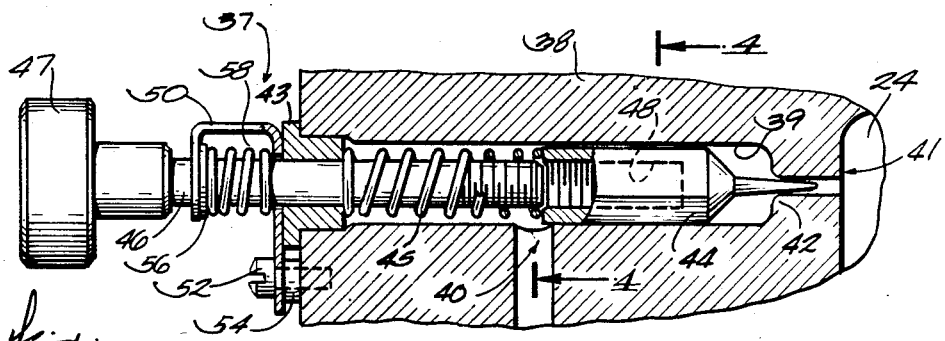
FIG. 2 is an enlarged view, partially cut away, of the needle valve apparatus of FIG. 1 with the needle seated.
Figure 3:
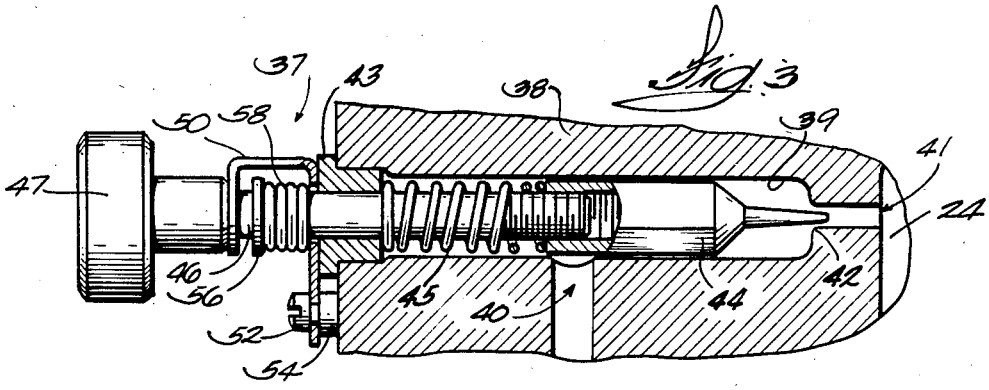
FIG. 3 is a view similar to the view of FIG. 2 with the needle unseated.

As best illustrated in FIGS. 2 and 3, the needle valve apparatus 37 includes wall means 38 defining an elongated enclosed chamber 39 having a longitudinal axis and opposite first and second ends. The wall means 38 is part of the plastic main body of the carburetor 12. The wall means 38 includes an inlet 40 communicating between the fuel passage 26 and the chamber 39, and, at the second end, an outlet 41 communicating between the chamber 39 and the fuel well 24. The outlet 41 includes a valve seat 42. Closing the first end of the chamber 39 is a plug or seal 43.

Figure 4:
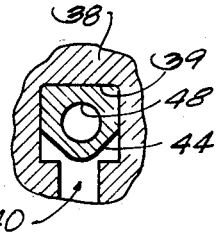
FIG. 4 is a cross-sectional view taken along line 4—4 in FIG. 2.

The valve apparatus 37 also includes a valve member 44 within the chamber 39 and including a body portion and a needle portion adapted to engage the valve seat 42. Preferably, the valve member 44 is made of extruded metal and the needle portion has a machined tip. The valve member 44 is movable within the chamber 39 along the longitudinal axis of the chamber 39 relative to a closed position wherein the needle portion sealingly engages the valve seat 42. In the preferred embodiment, the chamber 39 has a square cross section, as best shown in FIG. 4, and the body portion of the valve member 44 has a noncircular cross-section with an area less than the area of the cross-section of the chamber 39, as also best shown in FIG. 4, such that the valve member 44 cannot rotate within the chamber 39. Because of the lesser cross-sectional area of the valve member 44, fuel flow from the inlet 40 to the outlet 41 through the chamber 39 is not impeded by the valve member 44.

The valve apparatus 37 also includes means biasing the valve member 44 toward the closed position. While various suitable means for biasing the valve member 44 toward the closed position could be employed, in the illustrated construction, the biasing means includes a spring 45 positioned in the chamber 39 between the valve member 44 and the seal 43. The spring 45 serves to bias the valve member 44 toward the right as viewed in FIG. 2, thereby biasing the valve member 44 toward the closed or seated position.

The valve apparatus 37 also includes means selectively engageable with the valve member 44 for selectively and releasably moving the valve member 44 away from the closed position. Although various other suitable means could be employed for this purpose, in the preferred embodiment, this means includes an adjustment rod 46 extending through the seal 43 at the first end of the chamber 39 and having an end extending inwardly into the chamber 39 inside the spring 45. The adjustment rod 46 has a longitudinal axis parallel to the longitudinal axis of the chamber 39, and is rotatable about and movable along the longitudinal axis of the rod 46 inwardly into and outwardly of the chamber 39. Preferably, the adjustment rod 46 has a knob 47 on its outwardly extending end for facilitating rotation and axial movement of the adjustment rod 46. In the preferred embodiment, the adjustment rod 46 is an integral piece of molded plastic.

The means selectively engageable with the valve member 44 also includes selectively interengageable means on the end of the valve member 44 facing the seal 43 and on the end of the adjustment rod 46 extending inwardly into the chamber 39.

While various suitable selectively interengageable means on the valve member 44 and on the adjustment rod 46 could be employed, in the preferred embodiment, the selectively interengageable means includes, in the end of the valve member 44 facing the seal 43, an internally threaded bore 48 with a longitudinal axis parallel to the longitudinal axis of the chamber 39, and, on the end of the adjustment rod 46, an externally threaded portion adapted to threadably engage the internally threaded bore 48 in the valve member. The bore 48 has a longitudinal axis colinear with the longitudinal axis of the rod 46. For reasons that will be explained hereinafter, the threads on the end of the rod 46 and inside the bore 48 are left-handed threads.

In the preferred embodiment, the valve apparatus 37 further includes means restricting the movement of the adjustment rod 46 outwardly of the chamber 39 such that, when the end of the adjustment rod 46 is out of engagement with the threaded bore 48, the end of the rod 46 is positioned closely adjacent to the valve member 44. While various suitable means could be employed for this purpose, in the illustrated construction, the means restricting the movement of the adjustment rod 46 outwardly of the chamber 39 includes an adjustment rod clip 50 mounted on the outer surface of the wall means 38. As best shown in FIGS. 2 and 3, the adjustment rod clip 50 is generally U-shaped, having inner and outer legs, with the inner leg being longer than the outer leg. Each of the legs of the clip 50 includes an aperture slidably receiving the adjustment rod 46. The clip 50 is secured to the wall means 38 by a screw or fastener 52 extending through the inner leg of the clip 50, as shown in FIG. 2. In the illustrated construction, a spacer 54 is positioned between the clip 50 and the wall means 38. The clip 50 also serves to retain the seal 43 within the first end of the chamber 39.

The means restricting the movement of the adjustment rod 46 outwardly of the chamber 39 also includes a snap ring 56 fixedly attached to the adjustment rod 46 to prevent axial movement thereof and positioned between the legs of the clip 50. The diameter of the snap ring 56 is greater than the diameter of the aperture in the outer leg of the clip 50, so that the snap ring 56 engages the clip 50 to prevent further movement of the adjustment rod 46 outwardly of the chamber 39.

In the preferred embodiment, the valve apparatus 37 further comprises means biasing the adjustment rod 46 outwardly of the chamber 39, and means restricting the movement of the adjustment rod 46 inwardly into the chamber 39 such that after the adjustment rod 46 is moved inwardly into the chamber 39 and rotated so that the threaded end of the rod 46 engages the internally threaded bore 48 in the valve member 44, further rotation of the rod 46 causes the valve member 44 to move away from the closed position. While various suitable means could be used for these purposes, in the preferred embodiment, these means include a spring 58 surrounding the adjustment rod 46 and positioned between the snap ring 56 and the inner leg of the clip 50. The spring 58 biases the adjustment rod 46 outwardly of the chamber 39 and, when fully compressed, prevents movement of the adjustment rod 46 inwardly into the chamber 39.

The valve apparatus 37 operates as follows. When the valve member 44 is seated, or in the closed position, the threaded end of the adjustment rod 46 is positioned closely adjacent to the valve member 44, but out of engagement with the valve member 44. Both of the springs 45 and 58 are extended, with the spring 45 maintaining the valve member 44 in the closed position and the spring 58 biasing the adjustment rod 46 outwardly of the chamber 39 such that the snap ring 56 engages the outer leg of the clip 50.

To unseat the valve member 44, or to move the valve member 44 away from the closed position, the adjustment rod 46 is pushed inwardly so that the threaded end engages the threaded bore 49 in the valve member 44, and then the adjustment rod 46 is rotated in the counterclockwise direction (because the threads are left-handed) so that the adjustment rod 46 and the valve member 44 become threadedly engaged. It should be noted that the inward pushing of the rod 46 may initially cause the needle portion of the valve member 44 to be pushed against the valve seat 42, but the resulting force on the valve seat 42 due to this straight inward pushing will not be enough to damage the valve seat 42. A much greater force on a valve seat results when the needle is seated by turning an adjustment rod threaded into the carburetor body, because of the wedging action of the threads.

The inward movement of the adjustment rod 46 causes the spring 58 to be partially compressed, and rotation of the adjustment rod 46 to cause threaded engagement with the valve member 44 causes the spring 58 to be fully compressed. Once the spring 58 is fully compressed, further counterclockwise rotation of the adjustment rod 46 causes the valve member 44 to be unseated, or to move away from the closed position. The flow of fuel through the chamber 39 and into the fuel well 24 increases as the valve member 44 is moved away from the closed position. By turning the adjustment rod 46 counterclockwise to increase fuel flow (richer) or turning the adjustment rod clockwise to reduce fuel flow (leaner), the desired fuel flow rate can be attained. Turning the rod 46 counterclockwise to cause richer fuel flow and clockwise to cause leaner fuel flow is in keeping with carburetor industry standards, and this is why the threads of the rod 46 and bore 48 are left-handed.

To reseat the valve member 44 in order to stop fuel flow into the fuel well 24, the adjustment rod 46 is turned clockwise until it moves out of engagement with the valve member 44. When the adjustment rod 46 and valve member 44 separate, the spring 45 will have seated the valve member 44, and the spring 58 will extend so that the snap ring 56 on the adjustment rod 46 engages the outer leg of the adjustment rod clip 50. The valve apparatus 37 is then returned its original position. Because the valve member 44 is seated by the spring 45 rather than by turning a rod threaded into the wall of the carburetor, damage to the valve seat 42 is substantially avoided.

Various features of the invention are set forth in the following claims.

I claim:

1. A carburetor comprising a fuel/air induction passage, a secondary orifice communicating with said induction passage, and fuel supply means operable to supply fuel from a source of fuel to said secondary orifice, said fuel supply means including wall means defining an elongated chamber having a longitudinal axis and including an inlet communicating between the source of fuel and said chamber, and an end having an outlet communicating between said chamber and said secondary orifice, said outlet including a valve seat, a valve member within said chamber and including a needle portion adapted to engage said valve seat, said valve member being movable within said chamber along said longitudinal axis of said chamber relative to a closed position wherein said needle portion sealingly engages said valve seat, means biasing said valve member toward said closed position, and means selectively engageable with said valve member for selectively and releasably moving said valve member away from said closed position.

2. A carburetor as set forth in claim 1 wherein said chamber includes an other end opposite from said end having said outlet, and wherein said means biasing said valve member toward said closed position includes a spring positioned in said chamber between said valve member and said other end of said chamber.

3. A carburetor as set forth in claim 1 wherein said chamber has an other end opposite from said end having said outlet, wherein said valve member has opposite first and second ends, said first end of said valve member facing said other end of said chamber and said second end of said valve member facing said end of said chamber having said outlet and including said needle portion, and wherein said means selectively engageable with said valve member includes an adjustment rod extending through said wall means at said other end of said chamber and having an end extending inwardly into said chamber, and selectively interengageable means on said first end of said valve member and on said end of said adjustment rod.

4. A carburetor as set forth in claim 3 wherein said chamber has a noncircular cross-sectional area, wherein said valve member includes a body portion having a noncircular cross-sectional area less than the area of said chamber such that said body portion cannot rotate within said chamber, and wherein said selectively interengageable means on said valve member and on said rod includes, in said first end of said valve member, an internally threaded bore with a longitudinal axis parallel to said longitudinal axis of said chamber, and, on said end of said rod, an externally threaded portion adapted to threadably engage said internally threaded bore in said valve member, said adjustment rod having a longitudinal axis colinear with said longitudinal axis of said threaded bore and being rotatable about and movable along said longitudinal axis of said rod inwardly into and outwardly of said chamber.

5. A carburetor as set forth in claim 4 and further comprising means biasing said adjustment rod outwardly of said chamber, means restricting the movement of said adjustment rod outwardly of said chamber such that, when said end of said adjustment rod is out of engagement with said threaded bore, said end of said rod is positioned closely adjacent to said valve member, and means restricting the movement of said adjustment rod inwardly into said chamber such that, after said rod is moved inwardly into said chamber and rotated so that said threaded end of said rod engages said internally threaded bore in said valve member, further rotation of said rod causes said valve member to move away from said closed position.

6. A carburetor as set forth in claim 5 wherein said wall means includes an inner surface and an outer surface, said inner surface defining said chamber, and wherein said means restricting the movement of said adjustment rod outwardly of said chamber includes an adjustment rod clip mounted on said outer surface of said wall means and having a portion spaced from said outer surface and including an aperture in which said adjustment rod is slidably received, and a member fixedly attached to said adjustment rod to prevent axial movement thereof and being positioned between said portion of said clip and said outer surface of said wall means so as to be engageable with said portion of said clip to prevent further movement of said adjustment rod outwardly of said chamber.

7. A carburetor as set forth in claim 6 wherein said means biasing said adjusment rod outwardly of said chamber and said means restricting the movement of said adjustment rod inwardly into said chamber both include a spring surrounding said adjustment rod and being positioned between said member and said outer surface of said wall means, said spring biasing said adjustment rod outwardly of said chamber and, when fully compressed, preventing movement of said adjustment rod inwardly into said chamber.

8. A carburetor as set forth in claim 1 wherein said wall means is made of plastic.

9. A valve apparatus comprising wall means defining an elongated chamber having a noncircular cross-sectional area, a longitudinal axis, and including an inlet and an end having an outlet including a valve seat, a valve member within said chamber and including a body portion having a noncircular cross-sectional area less than the area of said chamber such that said body portion cannot rotate within said chamber, said valve member also including a needle portion adapted to engage said valve seat, said valve member being movable within said chamber along said longitudinal axis of said chamber relative to a closed position wherein said needle portion sealingly engages said valve seat, means biasing said valve member toward said closed position, and means selectively engageable with said valve member for selectively and releasably moving said valve member away from said closed position.

10. A valve apparatus as set forth in claim 9 wherein said means biasing said valve member toward said closed position includes a spring positioned in said chamber between said valve member and said other end of said chamber.

11. A valve apparatus as set forth in claim 9 wherein said chamber has an other end opposite said end having said outlet, wherein said valve member has opposite first and second ends, said first end of said valve member facing said other end of said chamber and said second end of said valve member facing said end of said chamber having said outlet and including said needle portion, and wherein said means selectively engageable with said valve member includes an adjustment rod extending through said wall means at said other end of said chamber and having an end extending inwardly into said chamber, and selectively interengageable means on said first end of said valve member and on said end of said adjustment rod.

12. A valve apparatus comprising wall means defining an elongated chamber having a longitudinal axis, and a noncircular cross-sectional area, and including an inlet, a first end, a second end opposite from said first end and having an outlet including a valve seat, a valve member within said chamber and including a first end facing said first end of said chamber and a second end opposite from said first end and facing said second end of said chamber and including a needle portion adapted to engage said valve seat, and a body portion having a noncircular cross-sectional area less than the area of said chamber such that said body portion cannot rotate within said chamber, said valve member being movable within said chamber along said longitudinal axis of said chamber relative to a closed position wherein said needle portion sealingly engages said valve seat, a spring positioned in said chamber between said valve member and said first end of said chamber for biasing said valve member toward said closed position, and means selectively engageable with said valve member for selectively and releasably moving said valve member away from said closed position, said means selectively engageable with said valve member including an adjustment rod extending through said wall means at said first end of said chamber and having an end extending inwardly into said chamber, and selectively interengageable means on said first end of said valve member and on said end of said adjustment rod, said selectively interengageable means on said valve member and on said rod including, in said first end of said valve member, an internally threaded bore with a longitudinal axis parallel to said longitudinal axis of said chamber, and, on said end of said rod, an externally threaded portion adapted to threadably engage said internally threaded bore in said valve member, said adjustment rod having a longitudinal axis colinear with said longitudinal axis of said threaded bore and being rotatable about and movable along said longitudinal axis of said rod inwardly into and outwardly of said chamber.

13. A valve apparatus as set forth in claim 12 and further comprising means biasing said adjustment rod outwardly of said chamber, means restricting the movement of said adjustment rod outwardly of said chamber such that, when said end of said adjustment rod is out of engagement with said threaded bore, said end of said rod is positioned closely adjacent to said valve member, and means restricting the movement of said adjustment rod inwardly into said chamber such that, after said rod is moved inwardly into said chamber and rotated so that said threaded end of said rod engages said internally threaded bore in said valve member, further rotation of said rod causes said valve member to move away from said closed position.

14. A valve apparatus as set forth in claim 13 wherein said wall means includes an inner surface and an outer surface, said inner surface defining said chamber, and wherein said means restricting the movement of said adjustment rod outwardly of said chamber includes an adjustment rod clip mounted on said outer surface of said wall means and having a portion spaced from said outer surface and including an aperture in which said adjustment rod is slidably received, and a member fixedly attached to said adjustment rod to prevent axial movement thereof and being positioned between said portion of said clip and said outer surface of said wall means so as to be engageable with said portion of said clip to prevent further movement of said adjustment rod outwardly of said chamber.

15. A valve apparatus as set forth in claim 14 wherein said means biasing said adjustment rod outwardly of said chamber and said means restricting the movement of said adjustment rod inwardly into said chamber both include a spring surrounding said adjustment rod and being positioned between said member and said outer surface of said wall means, said spring biasing said adjustment rod outwardly of said chamber and, when fully compressed, preventing movement of said adjustment rod inwardly into said chamber.

16. A valve apparatus as set forth in claim 12 wherein said wall means is made of plastic.

17. A valve apparatus comprising wall means defining an elongated enclosed chamber having a noncircular cross-sectional area, a longitudinal axis, and opposed first and second ends, said wall means including an inlet intermediate said first and second ends and, at said second end, an outlet including a valve seat, a valve member within said chamber and including a body portion having a noncircular cross-sectional area less than the area of said chamber such that said body portion cannot rotate within said chamber, said body portion including an end facing said first end of said chamber and having therein an internally threaded bore with a longitudinal axis parallel to said longitudinal axis of said chamber, said valve member also including a needle portion facing said valve seat and adapted to engage said valve seat, said valve member being movable within said chamber along said longitudinal axis of said chamber relative to a closed position wherein said needle portion sealingly engages said valve seat, an adjustment rod extending through said wall means at said first end of said chamber, said adjustment rod having a longitudinal axis colinear with said longitudinal axis of said threaded bore and being rotatable about and movable along said longitudinal axis of said rod inwardly into and outwardly of said chamber, said rod having an end extending inwardly into said chamber, said end being externally threaded and adapted to threadably engage said internally threaded bore in said valve member, means biasing said valve member toward said closed position, said means including a spring positioned in said chamber between said valve member and said first end of said chamber, means biasing said adjustment rod outwardly of said chamber, means restricting the movement of said adjustment rod outwardly of said chamber such that, when said threaded end of said adjustment rod is out of engagement with said threaded bore, said end of said rod is positioned closely adjacent said valve member, and means restricting the movement of said adjustment rod inwardly into said chamber such that, after said rod is moved inwardly into said chamber and rotated so that said threaded end of said rod engages said internally threaded bore in said valve member, further rotation of said rod causes said valve member to move away from said closed position.

18. A valve apparatus as set forth in claim 17 wherein said wall means includes an inner surface and an outer surface, said inner surface defining said chamber, and wherein said means restricting the movement of said adjustment rod outwardly of said chamber includes an adjustment rod clip mounted on said outer surface of said wall means and having a portion spaced from said outer surface and including an aperture in which said adjustment rod is slidably received, and a member fixedly attached to said adjustment rod to prevent axial movement thereof and being positioned between said portion of said clip and said outer surface of said wall means so as to be engageable with said portion of said clip to prevent further movement of said adjustment rod outwardly of said chamber.

19. A valve apparatus as set forth in claim 18 wherein said means biasing said adjusment rod outwardly of said chamber and said means restricting the movement of said adjustment rod inwardly into said chamber both include a spring surrounding said adjustment rod and being positioned between said member and said outer surface of said wall means, said spring biasing said adjustment rod outwardly of said chamber and, when fully compressed, preventing movement of said adjustment rod inwardly into said chamber.

20. A valve apparatus as set forth in claim 17 wherein said wall means is made of plastic.

* * * * *